US012402758B2

(12) United States Patent
Dokos

(10) Patent No.: US 12,402,758 B2
(45) Date of Patent: Sep. 2, 2025

(54) HIGHLY-ABSORBENT TOWEL

(71) Applicant: Gregory Paul Dokos, Salt Lake City, UT (US)

(72) Inventor: Gregory Paul Dokos, Salt Lake City, UT (US)

( * ) Notice: Subject to any disclaimer, the term of this patent is extended or adjusted under 35 U.S.C. 154(b) by 316 days.

(21) Appl. No.: 17/822,191

(22) Filed: Aug. 25, 2022

(65) Prior Publication Data

US 2023/0068906 A1 Mar. 2, 2023

Related U.S. Application Data

(60) Provisional application No. 63/237,340, filed on Aug. 26, 2021.

(51) Int. Cl.
*A47K 10/02* (2006.01)

(52) U.S. Cl.
CPC ..... *A47K 10/02* (2013.01)

(58) Field of Classification Search
CPC ..... A47K 10/02
See application file for complete search history.

(56) References Cited

U.S. PATENT DOCUMENTS 5,072,467 A * 12/1991 Hunt ..... A47G 9/062 5/419
5,443,880 A * 8/1995 Wike ..... A47K 10/02 2/253
5,729,846 A * 3/1998 Sullivan ..... A47G 9/062 5/923
9,332,858 B1 * 5/2016 Chiang ..... A47C 7/62
2007/0163027 A1 * 7/2007 Hamilton ..... A42C 5/04 2/171
2007/0289558 A1 * 12/2007 Bonfoey ..... A01K 13/006 119/850
2020/0281419 A1 * 9/2020 Mehringer ..... A47K 10/02

* cited by examiner

*Primary Examiner* — Andrew T Piziali
(74) *Attorney, Agent, or Firm* — Weaver Austin Villeneuve & Sampson LLP

(57) ABSTRACT

A highly-absorbent towel may comprise at least one pocket fastened to a material backing, wherein the pocket has an outer surface, on a side of the pocket opposite from the material backing, configured to wick moisture from outside the pocket to a removable absorbent insert inside the pocket, wherein the pocket includes a closable opening through which the removable absorbent insert may be inserted into and removed from the pocket.

14 Claims, 2 Drawing Sheets

HIGHLY-ABSORBENT TOWEL

RELATED APPLICATIONS

This application claims the benefit of U.S. Provisional Application No. 63/237,340, filed Aug. 26, 2021, entitled "Royal Rap Towel", which is assigned to the assignee hereof, and incorporated herein in its entirety by reference.

BACKGROUND

The present invention relates generally to an apparatus for a towel. More specifically, the present invention is an apparatus for a towel that is safer and gentler to use on skin.

Many people, including those with different afflictions, can benefit from a gentler form of drying. These different afflictions may include, for example, eczema, psoriasis, reoccurring sores, wounds, post-operative conditions like sutures or staples, bed sores, heat or chemical burns, sunburns, babies, even the elderly with thin frail skin. That said, other people may want to avoid the irritation and damage to the skin that may be caused by the scrubbing motion many people make with a traditional towel.

BRIEF SUMMARY

Embodiments address these and other issues by providing a highly-absorbent towel with one or more pockets. Each pocket may allow a removable absorbent insert, such as a sponge, to be inserted into the pocket. Each pocket may further comprise a wicking material that wicks moisture from outside the pocket to the removable absorbent insert inside the pocket. An opening of the pocket that allows for the insertion/removal of the absorbent insert may be closable by means of one or more flaps that close over the opening. According to some embodiments, a flap may extend across the opening and removably fasten to fasteners on the inside or outside of the opening.

This summary is neither intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim. The foregoing, together with other features and examples, will be described in more detail below in the following specification, claims, and accompanying drawings.

Like reference symbols in the various drawings indicate like elements, in accordance with certain example implementations. In addition, multiple instances of an element may be indicated by following a first number for the element with a letter or a hyphen and a second number. For example, multiple instances of an element 110 may be indicated as 110-1, 110-2, 110-3 etc. or as 110*a*, 110*b*, 110*c*, etc. When referring to such an element using only the first number, any instance of the element is to be understood (e.g., element 110 in the previous example would refer to elements 110-1, 110-2, and 110-3 or to elements 110*a*, 110*b*, and 110*c*).

DETAILED DESCRIPTION OF THE INVENTION

Several illustrative examples will now be described with respect to the accompanying drawings, which form a part hereof. While particular examples, in which one or more aspects of the disclosure may be implemented, are described below, other examples may be used, and various modifications may be made, without departing from the scope of the disclosure of the appended claims. All illustrations of the drawings are for the purpose of describing selected versions of the present invention and are not intended to limit the scope of the present invention.

As noted previously, people often use traditional towels to dry their skin by making a scrubbing or brushing motion across the skin. However, this can cause irritation and even damage to the skin, especially for individuals suffering from afflictions that may make their skin easily irritable and/or vulnerable to damage. Embodiments described herein provide for a highly absorbent towel that users may use, for example, to pat dry in an efficient and gentile manner.

It can be noted that, although particular embodiments described herein are described as being directed toward drying a user is a skin, alternative embodiments may not be so limited. Alternative embodiments may be used for other drying applications.

Figure 1:
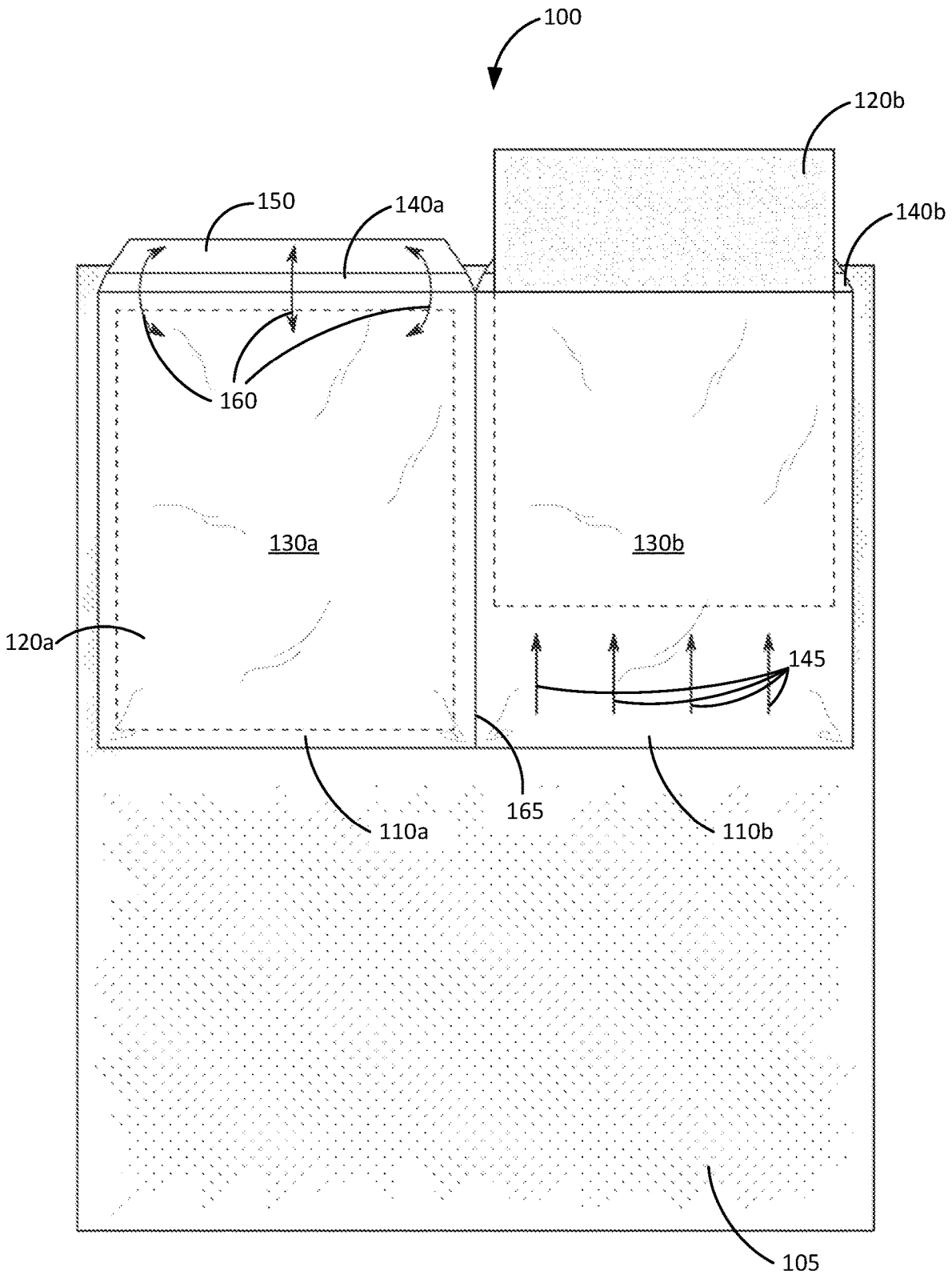
FIG. 1 is a drawing of an embodiment of a highly-absorbent towel, according to an embodiment.

FIG. 1 is an illustration of a highly-absorbent towel 100, according to an embodiment. The highly-absorbent towel 100 comprises a material platform 105 one or more pockets 110*a* and 110*b* (collectively and generically referred to herein as pocket(s) 110), into which a removable absorbent insert 120*a* and 120*b* (collectively and generically referred to herein as absorbent insert(s) 120) may be inserted.

FIG. 1 is provided as a nonlimiting example, and alternative embodiments may include one or more variations from the example shown in FIG. 1. For example, the highly-absorbent towel 100 may comprise a single pocket 110, or more pockets than illustrated. The one or more pockets 110 may be arranged in matters different than as shown in FIG. 1, including different locations on the material platform 105 (e.g., left/right, front/back, top/bottom, etc.). In some embodiments, multiple absorbent inserts 120 may be inserted into a single pocket 110. Some embodiments may include differently-sized pockets 110, pockets 110 having a different relative size to the material platform 105, or the like. A person of ordinary skill in the art will appreciate that other such variations may be made to the embodiment illustrated in FIG. 1.

The material backing 105 may comprise terry cloth (e.g., a traditional towel textile material) and/or another absorbent material. It may be made from one or more different fiber types, including natural (e.g., cotton) and/or artificial fibers (e.g., microfiber). Different aspects of the material backing 105, such as fiber type, thickness, and sides, may vary depending on application. For example, a relatively larger size may be used (e.g., 20"×40", 28"×54", etc.) as a replacement for a traditional bath towel, and a relatively smaller size may be used (e.g., 16"×28", 1"3×13", 12"×12", etc.) as a replacement for a traditional hand towel or washcloth.

As previously noted, a pocket 110 may be attached to a front and/or back surface of the material backing 105. Depending on factors such as manufacturing considerations, a pocket 110 may comprise a fully-formed pocket 110 that is attached to a material backing 105, or may comprise one or more pieces of material that, when attached to the material backing 105, form a pocket 110. An outer surface of the pocket 130*a* and 130*b* (collectively and generically referred to herein as outer surface(s) 130), on a side of the pocket opposite from the material backing 105, may be used for drying a user's skin by wicking moisture (e.g., water, liquid medicine, etc.) from the user skin to the absorbent insert 120 inside the pocket 110, and therefore may be porous and/or relatively thin (e.g., in relation to a traditional towel and/or the material backing 105). Because it may come in contact with a user's skin, the material may also be selected to be soft and/or smooth (e.g., to avoid catching on a skin feature or wound, or on a suture/staple on a wound). As such, according to some embodiments, a material used for and outer surface 130 of a pocket 110 may comprise silk or satin. The pocket 110 may be bonded of fastened to the material backing 105 by being sewn on, textile bonded (e.g., via an adhesive), and/or by other means.

Each pocket 110 comprises an opening 140 that allows for one or more absorbent inserts 120 to be inserted into and removed from the pocket 110. (In FIG. 1, inserted portions of the absorbent inserts 120 into the pockets 110 are illustrated by dotted lines.) The removeability of the absorbent inserts 120 allows for the absorbent inserts 120 to be washed and/or dried (e.g., rung out) separate from the rest of the highly-absorbent towel 100. (Removal of absorbent insert 120*b* from pocket 110*b* may be performed by moving the absorbent insert 120*b* in the direction of arrows 145, as illustrated in FIG. 1. Insertion into the pocket 110*b* would be performed in the opposite direction.)

To help ensure the absorbent insert 120 does not fall out of its respective pocket 110 during use, the pocket 110 may comprise a flap 150 to cover the opening 140. According to some embodiments, the flat may be secured over the opening using any of a variety of fasteners (not shown in FIG. 1), including one or more zippers, ties, snaps, resealable tapes, hook-and-loop fasteners (e.g., Velcro®), etc., or any combination thereof. As such, each pocket 110 may form a resealable/reusable pocket for the one or more absorbent inserts 120. Depending on desired functionality, the flap 150 may be moved (e.g., shown in the direction of arrows 160) to extend over the top of the pocket 110 to attach to the outer surface 130 of the pocket 110, or may extend into the pocket 110, removably fastening to an inner surface of the pocket 110. Alternatively (or additionally), the flap 150 may comprise an extension of the outer surface 130 that extends over the top of the pocket 110 and fastens to the material backing 105, on the inside of the pocket 110 or the outside of the pocket 110. In some embodiments, flaps 150 may extend from two opposite sides of a pocket 110 and fasten to each other (e.g., using a zipper).

Each absorbent insert 120 may be made from a highly-absorbent material. This may include, for example, natural and/or artificial sponges or sponge-like material, including polyester sponges and/or foam rubber pads. Aspects such as the absorbency, malleability/stiffness, size (e.g., including thickness), etc. of each absorbent insert 120 may vary, depending on the application.

A user may use the highly-absorbent towel 100, for example, by taking the following steps. First, a user may place the outer surface 130 of the pocket 110 on the area of the skin to be dried. The user may then gently apply pressure to the back of the pocket 110 (opposite the outer surface 130). The user may then slowly and evenly decrease pressure. As the pressure is reduced, the moisture will be drawn through the pocket 110 and into the absorbent insert 120 leaving the skin dry and the skin/hair roots undamaged. The user may then continue on to other portions of the skin to be dried.

The highly-absorbent towel 100 may be hung over a towel rack and/or folded into any of a variety of different configurations. According to some embodiments, a seam 165 may divide two pockets 110 (or two even groups of pockets 110), such that the highly-absorbent towel 100 is evenly balanced on either side of the seam 165, which can make it easier to balance on a towel rack (e.g., having a pocket 110 or even group of pockets 110 on either side of the towel rack). That said, depending on the materials used, the highly-absorbent towel 100 may still be capable of being draped over a towel rack without sliding off the tell rack and falling to the ground.

It can be noted that some embodiments of the highly-absorbent towel 100 may include one or more additional features, depending on desired functionality. In some embodiments, for example, the highly absorbent towel 100 may further include a rough material secured to the material backing 105 for exfoliation purposes. This rough material may comprise, for example, a foam or plastic scrubber material, such as a polyester scrubber material (e.g., similar to those used dish scrubber sponges). And may be located on the material backing 105 at a location separate from the one or more pockets 110, such as the opposite of the material backing 105. (E.g., if the one or more pockets 110 are located on the front of the highly-absorbent towel 100, one or more exfoliation pads may be located on the back.) An example size of an exfoliation pat may be 2"×2", although other embodiments may have one or more exfoliation pads larger or smaller than this.

Figure 2A:
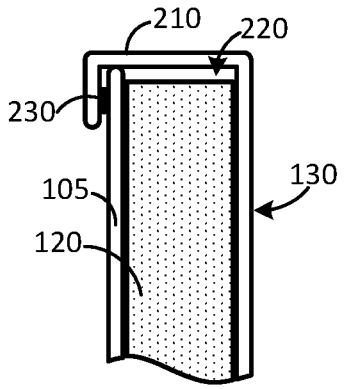
FIGS. 2A and 2B are simplified cross-sectional diagrams of embodiments of a portion of a highly-absorbent towel.
Figure 2B:
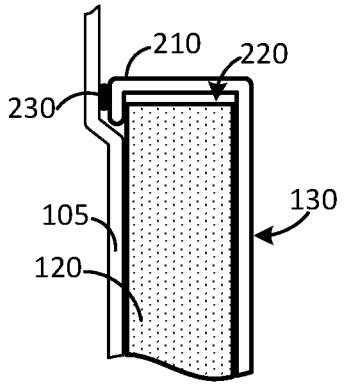

FIGS. 2A and 2B are simplified cross-sectional diagrams of a portion of the pocket and backing material 105, illustrating alternative embodiments for removably securing a flap 210 pocket over an opening of the pocket. Although embodiments illustrate how the flap 210 may extend from the outer surface 132 the backing material 105, embodiments may alternatively have a flap that extends from the backing material 105 to the outer surface 130 of the pocket, as previously explained.

In FIG. 2A, the flap 210 extends from the outer surface 130 of the pocket over the opening 220 of the pocket to secure with one or more fasteners 230 outside the pocket, on an opposite side of the backing material 105.

In FIG. 2B, the flap 210 extends from the outer surface 130 of the pocket over the opening 220 of the pocket to secure with one or more fasteners 230 inside the pocket/opening 220. Because the flap 210 secures to the inside of the opening, there is no need for the pocket to be located near an edge of the backing material 105 (e.g., to be able to wrap around the backing material 105 to fasteners on the backside of the backing material 105). This can enable, for example, a pocket to be located anywhere on the backing material 105 (e.g., away from an edge of the backing material 105).

The embodiments discussed herein are examples. Alternative embodiments may omit, substitute, or add various procedures or components as appropriate. For instance, features described with respect to certain embodiments may be combined in various other embodiments. Different aspects and elements of the embodiments may be combined in a similar manner. Also, technology evolves and, thus many of the elements are examples that do not limit the scope of the disclosure to those specific examples.

Terms, "and" and "or" as used herein, may include a variety of meanings that also is expected to depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein may be used to describe any feature, structure, or characteristic in the singular or may be used to describe some combination of features, structures, or characteristics. However, it should be noted that this is merely an illustrative example and claimed subject matter is not limited to this example. Furthermore, the term "at least one of" if used to associate a list, such as A, B, or C, can be interpreted to mean any combination of A, B, and/or C, such as A, AB, AA, AAB, AABBCCC, etc.

Having described several embodiments, various modifications, alternative constructions, and equivalents may be used without departing from the scope of the disclosure. For example, the above elements may merely be a component of a larger system, wherein other rules may take precedence over or otherwise modify the application of the various embodiments. Also, a number of steps may be undertaken before, during, or after the above elements are considered. Accordingly, the above description does not limit the scope of the disclosure.

What is claimed is:

1. A towel comprising:

a plurality of pockets fastened to a rectangular material backing comprising an absorbent material, wherein:

each pocket of the plurality of pockets has a respective outer surface comprising a wicking material different than the absorbent material, on a side of the pocket opposite from the material backing, configured to wick moisture from outside the pocket to a respective removable absorbent insert inside the pocket, the wicking material comprising silk or satin, and each pocket of the plurality of pockets includes a respective closable opening through which the respective removable absorbent insert of the pocket may be inserted into and removed from the pocket;

a seam dividing a first pocket of the plurality of pockets from a second pocket of the plurality of pockets; and the respective removable absorbent insert for at least one pocket of the plurality of pockets, wherein the respective removable absorbent insert comprises a sponge.

2. The towel of claim 1, wherein the respective closable opening of at least one pocket of the plurality of pockets is closable by means of a respective at least one flap of material extending from a first side of the respective closable opening to a second side on the opposite side of the respective closable opening.

3. The towel of claim 2, wherein for the at least one pocket of the plurality of pockets, the respective at least one flap of material extends from the material backing to the outer surface of the pocket.

4. The towel of claim 2, wherein for the at least one pocket of the plurality of pockets, the at least one respective flap of material extends from the outer surface of the pocket to the material backing.

5. The towel of claim 2, wherein the at least one pocket of the plurality of pockets further comprises a respective one or more fasteners enabling the respective at least one flap to be removably secured to the second side.

6. The towel of claim 5, wherein the respective one or more fasteners comprise one or more respective zippers, ties, snaps, resealable tapes, hook-and-loop fasteners, or any combination thereof.

7. The towel of claim 5, wherein, for the at least one pocket of the plurality of pockets, the respective one or more fasteners are located inside the respective closable opening enabling the respective at least one flap to be removably secured to the second side on the inside of the respective closable opening.

8. The towel of claim 5, wherein, for the at least one pocket of the plurality of pockets, the respective one or more fasteners are located outside the respective closable opening enabling the at least one respective flap to be removably secured to the second side on the outside of the respective closable opening.

9. The towel of claim 1, wherein the absorbent material comprises a terry cloth.

10. The towel of claim 1, wherein at least one pocket of the plurality of pockets is sewn or textile bonded to the material backing.

11. The towel of claim 1, further comprising an exfoliation material secured to the material backing.

12. The towel of claim 1, wherein the seam is situated on the towel such that the towel is substantially evenly balanced on either side of the seam.

13. The towel of claim 1, wherein the plurality of pockets comprises a group of pockets on either side of the seam.

14. The towel of claim 11, wherein the exfoliation material comprises a polyester scrubber material.

* * * * *